US007360796B2

(12) United States Patent
Sutherland et al.

(10) Patent No.: US 7,360,796 B2
(45) **Date of Patent: *Apr. 22, 2008**

(54) ELECTRICAL ISOLATION CONNECTOR SUBASSEMBLY FOR USE IN DIRECTIONAL DRILLING

(75) Inventors: Michael T. Sutherland, Calgary (CA); Rishi Gurjar, Edmonton (CA)

(73) Assignee: Ryan Energy Technologies, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/265,486

(22) Filed: Nov. 2, 2005

(65) Prior Publication Data

US 2006/0082136 A1 Apr. 20, 2006

Related U.S. Application Data

(63) Continuation of application No. 10/377,214, filed on Feb. 28, 2003, now Pat. No. 7,032,930.

(51) Int. Cl.
*F16L 11/12* (2006.01)

(52) U.S. Cl. ..... 285/47; 285/53; 285/333; 175/320; 175/40

(58) Field of Classification Search ..... 285/47, 285/48, 50, 53, 54, 52, 333, 334; 175/320, 175/40, 48
See application file for complete search history.

(56) References Cited

U.S. PATENT DOCUMENTS

| | | | |
|---|---|---|---|
| 4,496,174 | A | 1/1985 | McDonald |
| 4,684,946 | A | 8/1987 | Issenmann |
| 4,861,074 | A | 8/1989 | Eastlund |
| 5,138,313 | A | 8/1992 | Barrington |
| 5,163,714 | A | 11/1992 | Issenmann |
| 5,394,141 | A | 2/1995 | Soulier |
| 5,467,832 | A | 11/1995 | Oban |
| 6,050,353 | A | 4/2000 | Logan |
| 6,158,532 | A | 12/2000 | Logan et al. |
| 6,572,152 | B2 | 6/2003 | Dopf |

FOREIGN PATENT DOCUMENTS

| | | | |
|---|---|---|---|
| CA | 2151525 | A1 | 12/1996 |
| EP | 0940557 | A | 9/1999 |
| FR | 2618912 | A | 2/1989 |
| WO | WO-03/004826 | A | 1/2003 |

*Primary Examiner*—David Bochna
(74) *Attorney, Agent, or Firm*—Barnes & Thornburg LLP

(57) ABSTRACT

An electrical isolation connector subassembly for interconnecting adjacent tubular drill rods of a drilling system used in drilling bore holes in earth formations, the connector comprising an electrically insulative sleeve being sandwiched between two electrically isolated subassembly components, the sleeve providing an exterior gap between the edges of the spaced apart electrically isolated components, the exterior gap having a width of less than 50 cm.

11 Claims, 6 Drawing Sheets

10
38
36
34
40
62
46
17
32
92
30
90
28
42
100
16
14
79
81
96
94
70
68
76
56
52
50
44
48
18
102
33
20
64
65

188
176
180
184
186
178
134
140
144
116
126
162
161
120
149
170
168
160
167
150
118
128
154
114
146
132
142
122
138
112
151
194

ELECTRICAL ISOLATION CONNECTOR SUBASSEMBLY FOR USE IN DIRECTIONAL DRILLING

RELATED APPLICATION

This application is a continuation of U.S. patent application Ser. No. 10/377,214, filed Feb. 28, 2003 now U.S. Pat. No. 7,032,930.

FIELD OF THE INVENTION

This invention relates to an electrical isolation connector subassembly for use in data telemetry in directional drilling applications.

BACKGROUND OF THE INVENTION

The transmission of electromagnetic signals from a borehole to the earth surface is an effective method of communicating information during various types of drilling operations, such as measuring while drilling (MWD) and/or logging well drilling (LWD). The ability to communicate allows for the monitoring of drilling operations, as well as the inspection and evaluation of surrounding geology. During directional drilling operations, such as boring holes under river beds, subways, unusual earth formations and tapping oil reservoirs, it is particularly important at all times to know precisely the location of the drill bit. A significant effort has been made to develop electrical instruments which are capable of transmitting signals at the drill face or inspection face back to the earth's surface.

A number of systems have been developed which incorporate electromagnetic technology for communicating to the earth surface. For example, in U.S. Pat. No. 5,394,141, described is a system where the lower portion of the drill string is used as an antenna for purposes of transmitting electromagnetic waves carrying information.

Various types of devices which are mounted on the outside of the drill string for monitoring surrounding conditions and/or used in communication are described, for example, in U.S. Pat. No. 4,684,946 to Geoservices and U.S. Pat. No. 5,467,832 to Schlumberger Technology Corporation. The problem with mounting communication devices and sensing devices on the exterior of the drill string is that particularly with directional drilling the exterior devices are damaged by striking the formations about the bore hole.

In order to enhance communication with the earth's surface, it is preferred to electrically isolate drill string components so that electromagnetic signals can be developed for data telemetry. This is achieved by a subassembly connector which electrically isolates adjacent drill string components so that the isolated components provide the two terminals of an antenna to which an alternating current is applied in developing the electromagnetic signal for transmission to the earth's surface. Examples of such connectors are described in U.S. Pat. No. 6,050,353 to Ryan Energy, U.S. Pat. No. 5,138,313 to Haliburton Company, U.S. Pat. No. 5,163,714 to Geoservice and Canadian patent application 2,151,525 to McAllister Petroleum Services, Ltd.

The various types of subassemblies provide for electrical isolation which are particularly useful in bore hole inspection, but may be subject to failure when used, for example, in directional drilling. It has been found that the drill string, and in particular the subassembly connector, is subjected to extreme torsional compression, tension, and bending moments during directional drilling. Such extreme forces can result in connector failure, usually at the weakest point in the subassembly. The connectors of these patents and patent application may fail due to overstressing and possibly break up at their weakest point. Furthermore, in the prior art, such as U.S. Pat. No. 4,766,442, it is generally accepted that to prevent short circuiting of the alternating current applied to the subassembly, a substantial gap spacing (i.e. 50 cm or more) is necessary. These large gaps require a protective wrapping, as the abrasive conditions during drilling can quickly damage the insulative materials used in these gaps. However, the protective wrapping is also subject to extreme abrasive forces and are consequently prone to frequent failure, thus necessitating frequent replacement.

SUMMARY OF THE INVENTION

In accordance with an aspect of this invention, provided is an electrical isolation connector subassembly for use in data telemetry in directional drilling applications. The electrical isolation connector subassembly of the current invention has enhanced strength characteristics due to a more robust design, and incorporates a considerably smaller gap region between the electrically isolated adjacent drill string components, thereby reducing the amount of wear to the insulative surfaces and eliminating the need for a protective wrapping.

In accordance with an aspect of this invention, provided is an electrical isolation connector subassembly for interconnecting adjacent tubular drill rods of a drilling system used in drilling bore holes in earth formations, said connector comprising an electrically insulative sleeve being sandwiched between two electrically isolated subassembly components, the sleeve providing an exterior gap between the edges of the spaced apart electrically isolated components, the exterior gap having a width of less than 50 cm.

In accordance with an aspect of this invention, provided is an-electrical isolation connector subassembly for interconnecting adjacent tubular drill rods of a drilling system used in drilling bore holes in earth formations, said connector comprising:

a first electrically isolated component;

a second electrically isolated component;

a plurality of insulator sleeves;

the first electrically isolated component being adapted on one end to connect to a first tubular drill rod;

the second electrically isolated component being adapted on one end to connect to a second tubular drill rod;

said plurality of insulator sleeves electrically separating said first and second electrically isolated components;

wherein at least one of said insulator sleeves is sandwiched between the first and second electrically isolated components, providing an exterior gap between the edges of the spaced apart first and second electrically isolated components, the exterior gap having a width of less than 50 cm. electrically isolated In accordance with a further aspect of this invention, provided is an electrical isolation connector subassembly for interconnecting adjacent tubular drill rods of a drilling system used in drilling bore holes in earth formations, said connector comprising:

a mandrel, wherein said mandrel is adapted at one end to connect to a first tubular drill rod;

a housing, wherein said housing is adapted at one end to connect to a second tubular drill rod;

a conductive ring located on an external surface of said connector;

a plurality of insulator sleeves;

said mandrel and said housing being electrically continuous;

said conductive ring being electrically isolated from said mandrel and said housing by said insulator sleeves;

an electrode assembly that engages said conductive ring wherein said electrode assembly is electrically isolated from said mandrel and said housing, said electrode assembly being positioned within openings in said mandrel wherein said openings extends perpendicular to the longitudinal axis of the electrical isolation connector subassembly;

wherein said insulator sleeves are sandwiched between the conductive ring and adjacent opposing faces of the subassembly, providing an exterior gap having a width of less than 50 cm.

DETAILED DESCRIPTION OF THE PREFERRED EMBODIMENTS

Various aspects of the invention are described in detail where it is appreciated that the principles of the invention, as established in the detailed description of the drawings, may find application for use in data telemetry during directional drilling operations. The purpose of the invention is to electrically isolate drill rod components so as to form an antenna, preferably adjacent the location of the drill bit. The antenna transmits electromagnetic data signals to the earth surface that are interpreted and used for various informational purposes, such as for the inspection and evaluation of bore holes. Quite surprisingly, applicant has found that the external gap between the electrically isolated components can actually be less than 50 cm. This was never thought possible as per the prior art. By virtue of this shortened external gap the invention can provide a robust drilling subassembly. This shortened external gap greatly facilitates manufacture and assembly of the subassembly. Although the spacing may be less than 50 cm, the preferred spacing is from about ½ cm to less 50 cm, or about 1 cm to about 40 cm, or more preferably about 2 cm to about 30 cm, or about 3 cm to about 20 cm, or most preferably about 5 cm to about 10 cm. The most preferred range is about 5 cm to about 10 cm, from the standpoint of machining the various components, particularly the internal portions thereof. From the standpoint of effectiveness of signal generation, it is appreciated as the gap is shortened, the efficiency level decreases. However, for the preferred range of about 5 cm to 10 cm, the system is very effective in generating a signal and usually does not improve very much in effectiveness for gap spacing greater than about 20 cm. These conditions, of course, do vary depending upon the earth formation characteristics.

Figure 1:
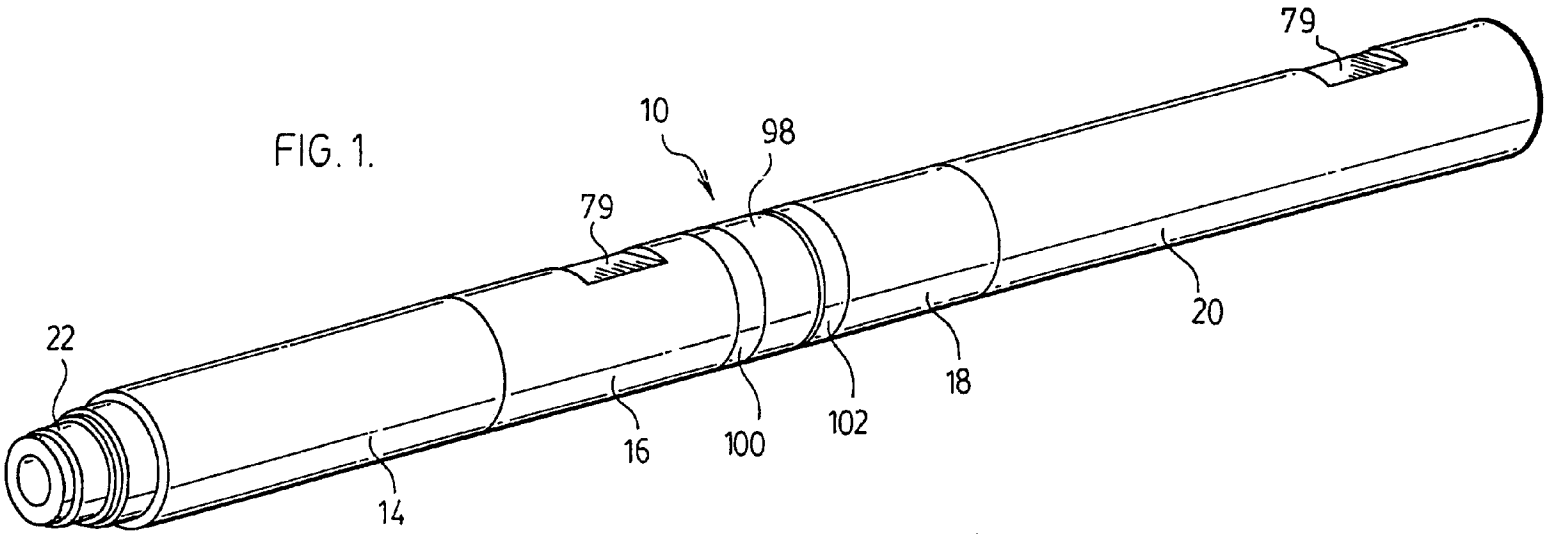
FIG. 1 is a perspective view of an assembled electrical isolation connector subassembly of the current invention.
Figure 2:
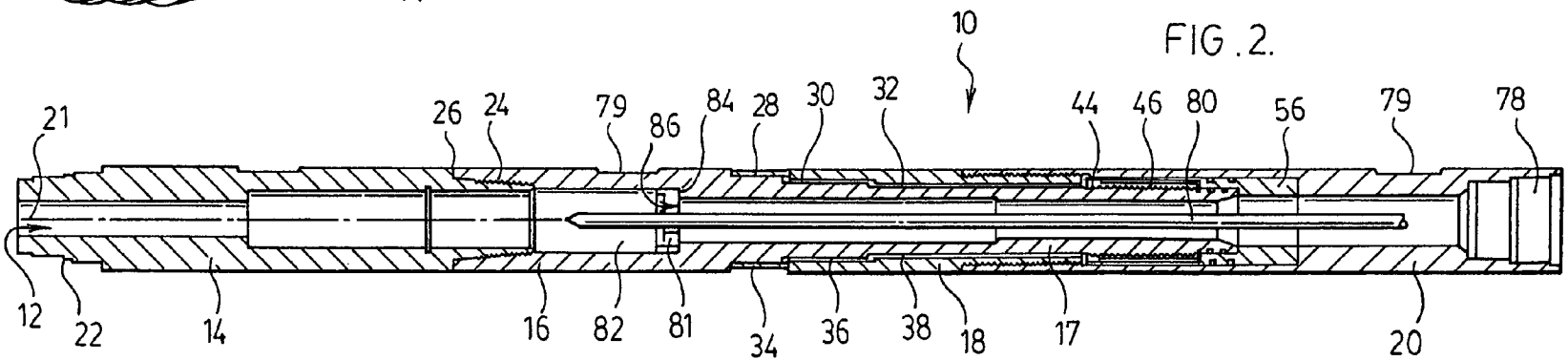
FIG. 2 is a section through the electrical isolation connector subassembly of FIG. 1.
Figure 3:
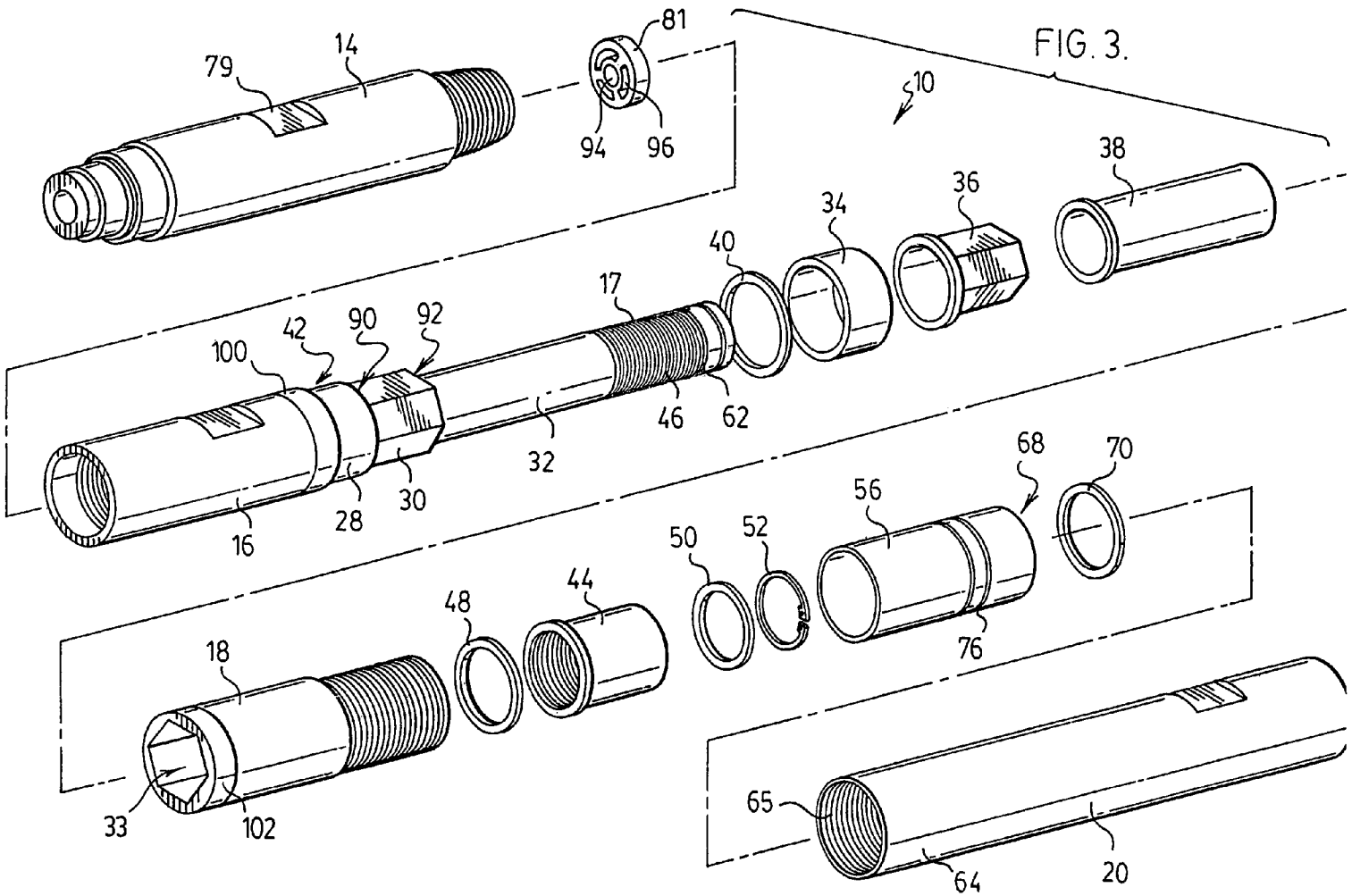
FIG. 3 is an exploded view in perspective of the electrical isolation connector subassembly of FIG. 1.

The electrical isolation connector subassembly generally comprises a first electrically isolated component and a second electrically isolated component, the two electrically isolated, components being separated by a insulative sleeves. As will be discussed in more detail, the subassembly comprises at least one insulative sleeve that is sandwiched between the two electrically isolated subassembly components, the sleeve providing an exterior gap between the edges of the spaced apart electrically isolated components, the exterior gap having a width of less than 50 cm. With specific reference to FIGS. 1, 2 and 3, shown is an assembled electrical isolation connector subassembly 10, ready for installation into a drill string. The electrical isolation connector subassembly 10 shown in these figures comprises a longitudinal bore 12, a first coupler 14, a mandrel 16, a gap housing 18 and a second coupler 20, the components being of circular cross-section, of the same outside diameter and coaxial about the longitudinal axis 21. The first coupler 14 has a first end 22 adapted to connect to a first drill string component, and a second end 24 adapted with inwardly tapered outside-surface threads to threadably and conductively engage the mandrel 16, the mandrel 16 having a corresponding inside-surface threaded mating surface. The first coupler 14 and the mandrel 16 when assembled form the first electrically isolated component, this joined assembly having a continuous outer surface 26. The gap housing 18 and the second coupler 20 form the second electrically isolated component. The elongate body of the mandrel 16 has an outer surface that tapers inwardly in a stepwise manner towards an inside end 17, in a direction towards the second coupler 20, the steps being first step 28, second step 30 and third step 32. To prevent longitudinal axial rotation of the gap housing 18 with reference to the mandrel 16, the interface of these two components, that being the second step 30 and an inside surface of a first end 33 of the gap housing 18 are configured with non-circular mating surfaces so that when assembled, the mandrel 16 and gap housing 18 are maintained in a non-rotatable relationship to one another. The hexagonal mating configuration is shown in FIG. 3.

To prevent electrical contact between the mandrel 16 and the gap housing 18, there is positioned between the mandrel 16 and the gap housing 18 a plurality of electrically non-conductive insulator sleeves, the insulator sleeves being placed over-top the above mentioned steps (28, 30, 32). The electrically non-conductive insulator sleeves are removable elements that can be reused, thereby simplifying assembly and disassembly of the connector. It is appreciated, however, that alternative insulators could be substituted. For example, the insulative sleeves could be formed in place by means of a suitable insulative material injection process for filling the space occupied by the sleeve. For the purpose of describing the invention the following assumes use of the removable/reusable insulative sleeves. Positioned over first step 28, second step 30 and third step 32 is first insulator sleeve 34, second insulator sleeve 36 and third insulator sleeve 38, respectively. As mentioned above, the outer surface of second step 30 is non-circular to prevent longitudinal axial rotation of the gap housing 18 with reference to the mandrel 16. Drilling torque is thereby transmitted from the upper drill along through the subassembly 10 to the lower drill string. Therefore, the shape of the second insulator sleeve 36 is configured to match that of the gap housing 18 and mandrel 16. In FIG. 3, where a hexagonal mating configuration is represented, the second insulator sleeve 36 is shown with the corresponding hexagonal shape.

Figure 4:
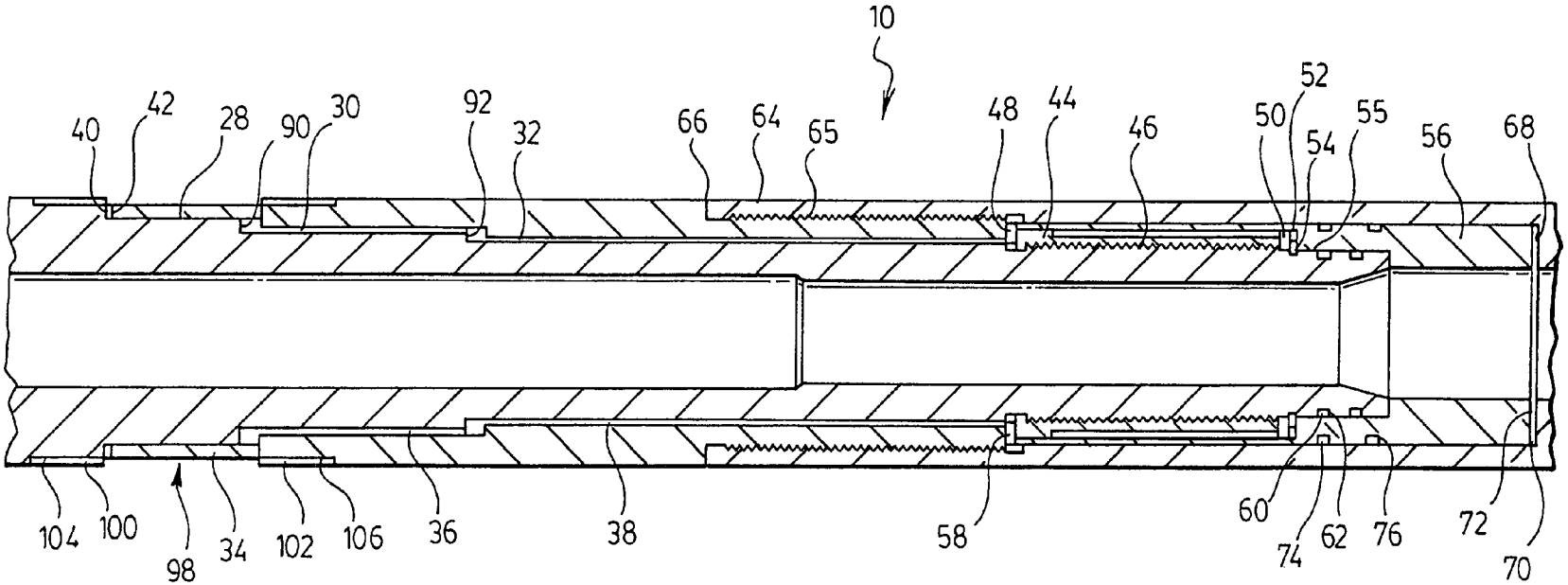
FIG. 4 is an enlarged sectional view of the electrical isolation connector subassembly of FIG. 1 showing further details of the subassembly.

To prevent ingress of drilling mud into the assembly, a compression gasket 40 is positioned between mandrel shoulder 42 and the edge of the first insulator sleeve 34 (see FIG. 4). To maintain the insulator sleeves (34, 36, 38) in place on the mandrel 16, a retaining nut 44 is used that threadably engages the threads 46 of the mandrel 16, the threads 46 being located on the outside surface of the mandrels inside end 17. By tightening the retaining nut 44, the electrically non-conductive insulator sleeves (34, 36, 38) and the compression gasket 40 are biased towards the respective first shoulder 42, second shoulder 90 and third shoulder 92 machined at each step (28, 30, 32) of the mandrel 16 so as to ensure a contiguous electrically non-conductive layer as well as to provide a seal against the ingress of drilling mud (see FIG. 4 for an enlarged, more detailed view of the region containing the various insulative sleeves, the retaining nut and other associated components).

Positioned between the third insulator sleeve 38 and the retaining nut 44 is an insulator spacer 48, wherein the insulator spacer 48 prevents electrical contact between the retaining nut 44 and the gap housing 18. To lock the retaining nut 44 in place, immediately adjacent the threads 46 of the mandrel 16 and the retaining nut 44, to the side towards the second coupler 20, is positioned a retaining washer 50 and a retaining clip 52. The retaining clip 52 is received by a circumferential box-shaped groove 54 on the outer surface of the tapered end 55 of the mandrel 16. To prevent electrical contact between the mandrel 16 and the second coupler 20, an aft insulator 56 is positioned over the retaining nut 44, the aft insulator 56 having an end face 58 that abuts the insulator spacer 48. To ensure a seal between the aft insulator 56 and the mandrel 16, the inside end 17 of the mandrel 16 is adapted to receive a plurality of o-rings 60 fitted within circumferential box-shaped grooves 62.

To attach the second coupler 20 to the assembly, the second coupler 20 is adapted at a first end 64 with inside-surface threads 65 to threadably and conductively engage the gap housing 18, the gap housing 18 having a corresponding outside-surface threaded mating surface. Upon assembly, the second coupler and gap housing form a smooth outer surface 66. Adjacent to the end face 68 of the aft insulator 56, is positioned a gasket 70 that is sandwiched between the aft insulator 56 and an inside shoulder 72 of the second coupler 20. To ensure a seal between the aft insulator 56 and the second coupler 20, the outer surface of the aft insulator 56 is adapted to receive a plurality of o-rings 74 fitted within circumferential box-shaped grooves 76. To facilitate placement of the electrical isolation connector subassembly 10 within a drill string, the second coupler 20 is adapted at a second end 78 to engage a second drill string component (See FIG. 2). To permit labelling of the various components of the assembly with, for example, serial numbers, the outside surface of first coupler 14, the mandrel 16 and the second coupler 20 is machined with a recessed flat surface.

With the electrical isolation connector subassembly 10 assembled, there are two electrically isolated regions being separated by the contiguous insulative structure comprising the plurality of electrically non-conductive insulator sleeves (34, 36, 38), the insulator spacer 48 and the aft insulator 56, the first electrically isolated region comprising the first coupler 14 and mandrel 16, and the second electrically isolated region comprising the gap housing 18 and second coupler 20. At the surface of the electrical isolation connector subassembly 10, the two electrically isolated regions are separated by n exterior gap 98 that is preferably less than 50 cm, with the gap surface being the exposed surface of the first insulative sleeve 34 (as shown in FIG. 4). To each side of the gap, there are wear shoulders 100, 102, the wear shoulders 100, 102 being received in respective circumferential recesses 104, 106 machined into the mandrel 16 and gap housing 18.

In addition, with the electrical isolation connector subassembly 10 assembled, there is a continuous longitudinal bore 12 that runs through the electrical isolation connector subassembly 10, allowing for placement of a transmitter electrode. The transmitter electrode 80 is housed within a wear resistant electrically insulative wash tube (not shown) that is aligned concentrically with the longitudinal axis 21 (see FIG. 2). To facilitate placement of the transmitter electrode 80 on the wash tube within the longitudinal bore 12, a centering disk or spider 81 is used. The centering disk 81 is positioned within the longitudinal bore 12 in the non-tapered region 82 of the mandrel 16. The centering disk 81 is configured with an outside diameter that corresponds to the inside diameter of the non-tapered region. 82 of the longitudinal bore 12 and is positioned having a face 84 abutting an interior shoulder 86 of the mandrel 16 to aid in maintaining it in a fixed position relative to the mandrel inside surface. The centering disk 81 has an aperture 94 coaxially aligned with the longitudinal axis 21 through which the transmitter electrode is positioned and further comprises a plurality of apertures 96 to facilitate the passage of drill fluid or medium.

To operate, an alternating signal is applied to the electrically isolated regions for transmitting an electromagnetic signal back to the surface, for example, in the manner described in U.S. Pat. Nos. 5,138,313 and 5,163,714.

Figure 5:
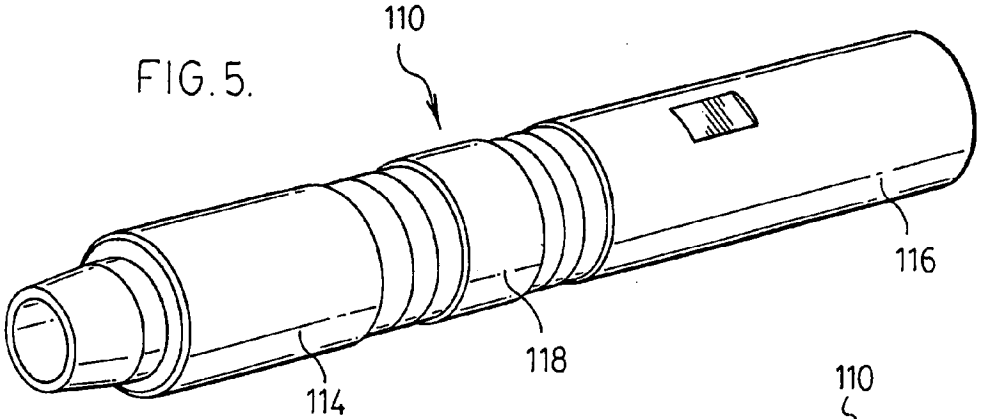
FIG. 5 is a perspective view of an alternate embodiment of the electrical isolation connector subassembly, shown assembled.
Figure 6:
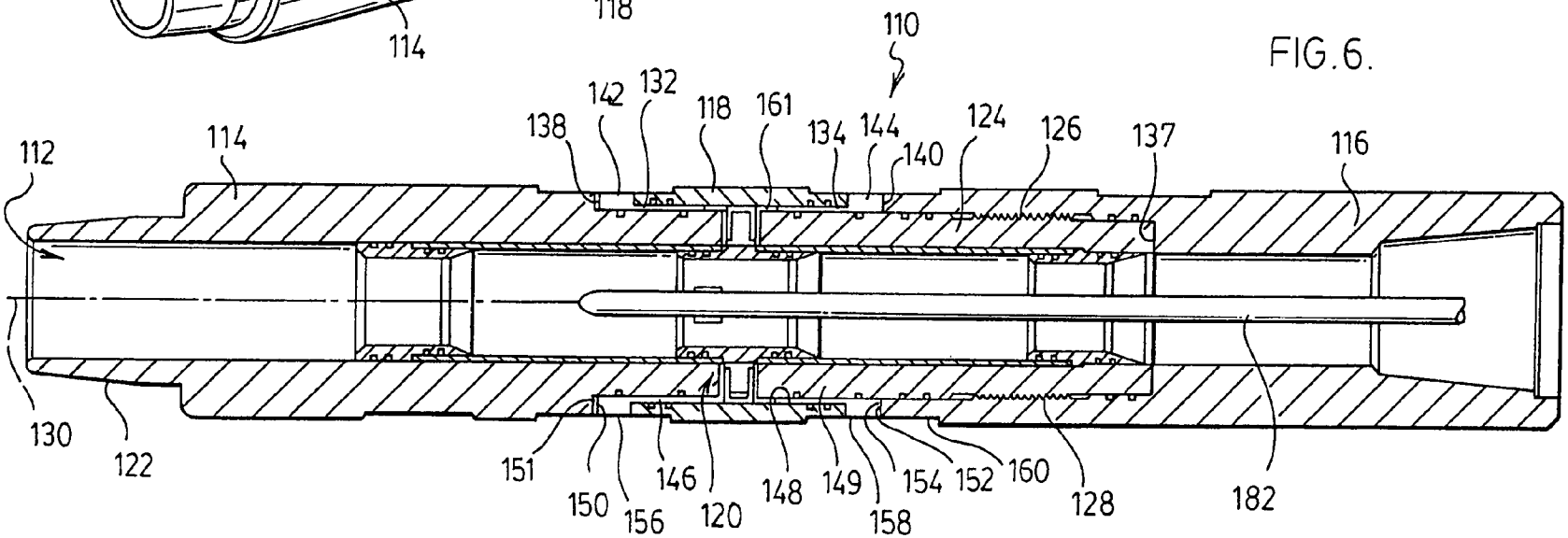
FIG. 6 is a section through the electrical isolation connector subassembly of FIG. 5.
Figure 7:
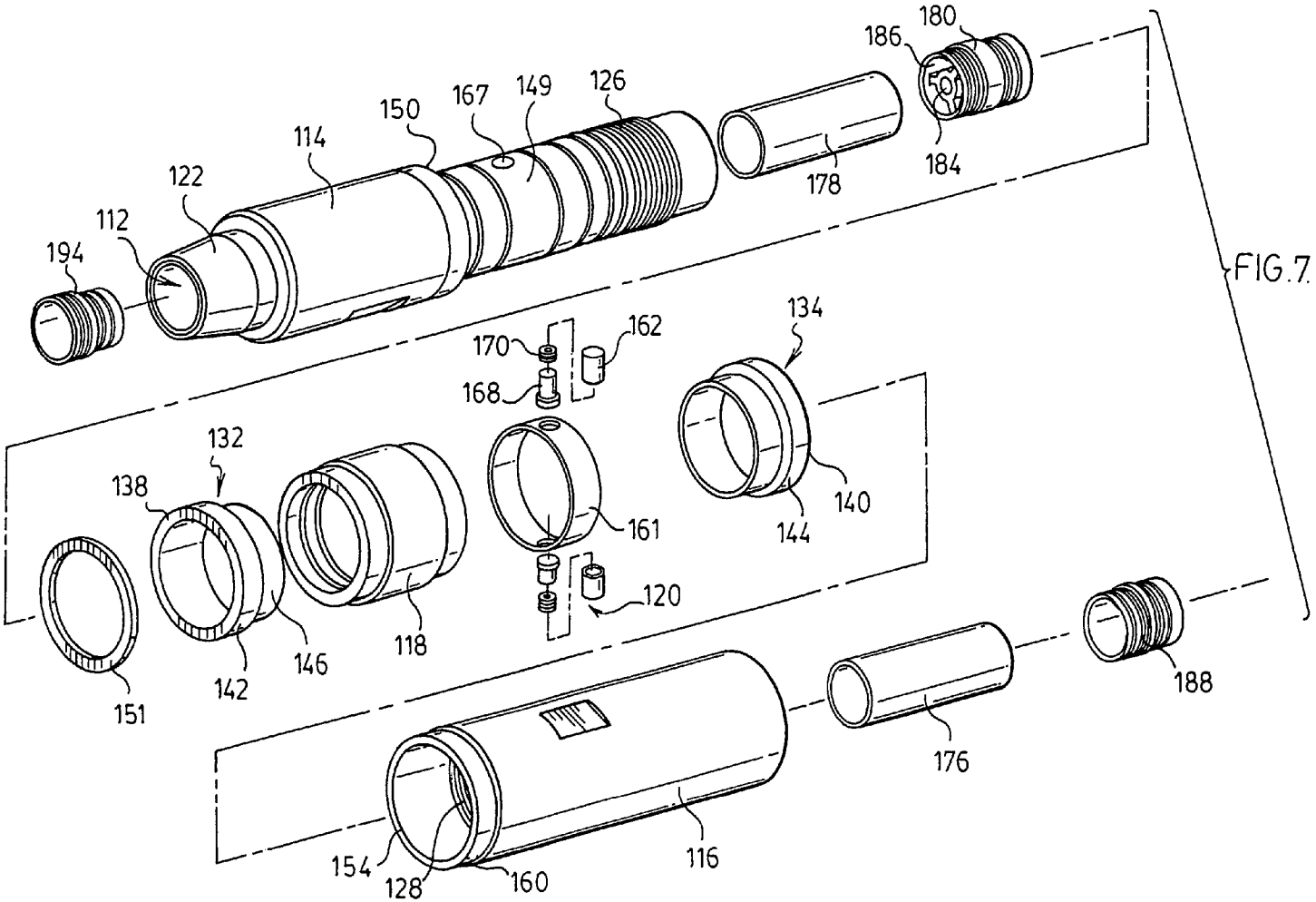
FIG. 7 is an exploded view in perspective of the electrical isolation connector subassembly of FIG. 5.

Shown in FIGS. 5, 6 and 7 are alternate embodiments of the present invention, an electrical isolation connector subassembly 110, shown assembled and ready for installation into a drill string. The electrical isolation connector subassembly 110 comprises a longitudinal bore 112, a mandrel 114, a housing 116, a conductive ring 118 and an electrode assembly 120. As will be described in more detail, the conductive ring 118 is electrically isolated from the electrically continuous mandrel 114 and housing 116 by a plurality of insulator sleeves. The mandrel 114 has a first end 122 adapted to connect to a first drill string component, and a second end 124 adapted with outside-surface threads 126 to threadably and conductively engage the housing 116, the housing 116 having a corresponding inside-surface threaded mating surface 128. The drilling torque is transmitted through the subassembly by the threaded connections at 126/128. The mandrel 114, the housing 116 and the conductive ring 118 each have the same outside diameter and are coaxially aligned with the longitudinal axis 130. When assembled, the second end 124 of the mandrel 114 abuts an inside shoulder 137 of the housing 116.

To electrically isolate the conductive ring from the mandrel 114 and housing 116, electrically non-conductive insulator sleeves are used, those being a first ring conductor insulator 132 and a second ring conductor insulator 134. As mentioned in the previous embodiment, the insulator sleeves are removable and reusable. It is appreciated, however, that the removable/reusable insulator sleeves could be substituted with a formed-in-place insulator using a suitable insulative material injection process. The removable/reusable insulator sleeves are used in the following discussion. The ring conductor insulators (132, 134) are "L" shaped, oriented such that the outer sides (138, 140) of the short portions (142, 144) separates the conductive ring from the adjacent structure (the mandrel 114 in the case of the first ring conductor insulator 132 and the housing 116 in the case of the second ring conductor insulator 134), and with the long portion 146 separating the underside 148 of the conductive ring 118 from the mandrel 114. To accommodate placement of the ring conductor insulators 132, 134, the mandrel 114 outside diameter steps circumferentially inwards, defining a smaller diameter region 149 of the mandrel 114, the step forming shoulder 150. An opposing shoulder 152 is formed by an end face 154 of the housing 116. This smaller diameter portion 149 of the mandrel 114 permits the positioning of the ring conductor insulators (132, 134) such that when assembled, exterior gap 156, 158 of the ring conductor insulators 132, 134 remain slightly recessed in comparison to the remainder of the assembly, and maintain an exterior gap that is less than 50 cm in width.

The mandrel 114, the housing 116 and the conductive ring 118, in the areas immediately adjacent the exterior gap 156, 158 of the ring conductor insulators 132, 134, are slightly recessed 160 to accommodate placement of an abrasion resistant wrapping (not shown), the recess being sufficiently deep to align with the exterior gap 156, 158 of the ring conductor insulators 132, 134. In addition to the two ring conductor insulators 132, 134, there is positioned adjacent the two long portions 146 of the ring conductor insulators 132, 134, between the conductive ring 118 and the mandrel 114, a central insulator 161. This central insulator 161 is machined with apertures, to allow passage of a conductor cap 162 of the electrode assembly 120. To prevent the ingress of drilling mud, a plurality of seals are incorporated into the assembly (See FIG. 8 for identification of seal structures). At the surface, a compression gasket 151 is sandwiched between the first ring conductor insulator 132 and the shoulder 150 of the mandrel 114. Internally, the underside of the conductive ring 118, the outer surface of the smaller diameter portion of the mandrel 114 and the outer surface of the second end 124 of the mandrel 114 are fitted with o-rings 164, received by circumferential box-shaped grooves 166.

Figure 8:
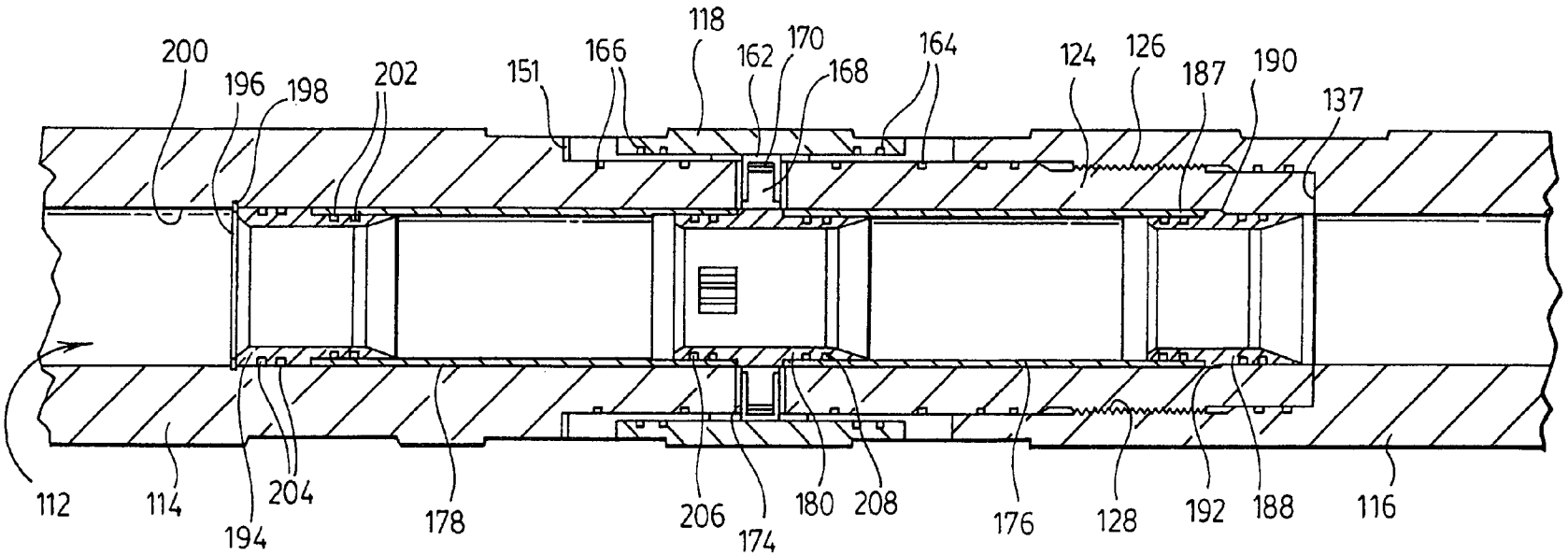
FIG. 8 is an enlarged sectional view of the electrical isolation connector subassembly of FIG. 5 showing further details of the subassembly.

The electrode assembly 120, as shown in FIGS. 7 and 8, is the means by which a signal is delivered to the conductive ring 118 and is positioned within an electrode aperture 167 machined in the mandrel 114, wherein said aperture extends perpendicular to the longitudinal axis. The electrode assembly 120 is comprised of a conductor base 168, a spring 170, and a conductor cap 162, with the spring 170 being positioned against the conductor base 168 and biased to impart pressure against the conductor cap 162 thereby causing contact between the conductor cap 162 and the conductive ring 118. The electrode assembly 120 is electrically isolated from the mandrel 114 by an electrically non-conductive transverse insulator 174 that lines the electrode aperture 167 in the mandrel 114.

Positioned within the longitudinal bore 112 of the electrical isolation connector subassembly 110, is a first wash pipe 176 and a second wash pipe 178, each wash pipe 176, 178 being manufactured of electrically non-conductive material and situated having partial overlap with the transverse insulator 174 such that the central wash pipe coupler 180 is electrically insulated from the mandrel 114. The central wash pipe coupler 180 maintains the transmitter electrode 182 in a coaxial alignment with the longitudinal axis 130 of the assembly by means of a central aperture 184. Additional apertures 186 are machined into the central wash pipe coupler 180 to permit passage of drill mud and material. At the end 187 opposite the central wash pipe coupler 180, the first wash pipe 176 is maintained in position by an upper wash pipe cup 188. The upper wash pipe cup 188 is fixed within the longitudinal bore 112 of the assembly by having chamfered shoulder 190 positioned up against a corresponding chamfered shoulder 192 machined into the inside surface of the mandrel 114. Similarly, the second wash pipe 178 is held in position, up against the central wash pipe coupler 180 by means of a lower wash pipe cup 194. The lower wash pipe cup 194 is maintained in position by a snap ring 196, the snap ring 196 being received by a circumferential box-shaped groove 198 on the inside surface 200 of the mandrel 114.

To ensure that drilling mud flows through the wash pipes 176, 178 and not around it, a plurality of seals are incorporated into the assembly. Each wash pipe cup 188, 194 has two sets of o-rings, sitting within circumferential box-shaped grooves, the first set of o-rings 202 ensuring a seal between the wash pipe cups 188, 194 and the wash pipes 176, 178, and a second set of o-rings 204 ensuring a seal between the wash pipe cups 188, 194 and the mandrel 114. Additional o-rings 206 are located on the central wash pipe coupler 180, held within circumferential box-shaped grooves 208, positioned between the central wash pipe coupler 180 and the wash pipes 176, 178.

As was mentioned above for the first embodiment, to send a signal from the subassembly, an alternating signal is applied to the electrically isolated regions for transmitting an electromagnetic signal back to the surface, for example, in the manner described in U.S. Pat. Nos. 5,138,313 and 5,163,714.

Although preferred embodiments of the invention have been described herein in detail, it will be understood by those skilled in the art that variations may be made thereto without departing from the spirit of the invention or the scope of the appended claims.

What is claimed is:

1. An electrical connector subassembly for interconnecting adjacent tubular drill rods of a drilling system used in drilling bore holes in earth formations, said connector subassembly comprising:

a first electrically isolated component comprising a mandrel and a first coupler;

a second electrically isolated component comprising a gap housing and a second coupler;

the first electrically isolated component being adapted on one end to connect to a first tubular drill rod; the second electrically isolated component being adapted on one end to connect to a second tubular drill rod;

said mandrel having an outer surface which tapers inwardly in stepwise manner in a direction towards the gap housing;

said gap housing having an inner surface which tapers inwardly in stepwise manner in a direction towards the second coupler;

said mandrel being telescopically received in said gap housing; and a plurality of insulator sleeves electrically separating said first and second electrically insulated components;

one of said insulator sleeves being located over a first of the taper steps of the mandrel and sandwiched between the first and second electrically isolated components, providing an exterior gap between the edges of the spaced apart first and second electrically isolated components, the exterior gap having a width of less than 50 cm;

others of said insulator sleeves being received on the next ones of the taper steps of the mandrel and sandwiched between the respective taper step of the mandrel and the mating taper step of the gap housing.

2. The electrical isolation connector subassembly of claim 1, wherein the telescoping interface between said mandrel and said gap housing is adapted to prevent longitudinal axial rotation of said gap housing with reference to said mandrel.

3. The electrical isolation connector subassembly of claim 1, wherein said plurality of insulator sleeves include a first insulator sleeve, a second insulator sleeve and a third insulator sleeve.

4. The electrical isolation connector subassembly of claim 1, wherein a retaining nut is used to urge said gap housing towards said mandrel, thereby imparting compressive pressure upon said insulator sleeves to prevent, the ingress of drilling mud into said subassembly.

5. The electrical isolation connector subassembly of claim 4, wherein said retaining nut is electrically isolated from said gap housing using an insulator spacer.

6. The electrical isolation connector subassembly of claim 4, wherein said retaining nut and a terminal end of said first electrically isolated component is electrically isolated from said second electrically isolated component using an aft insulator, said aft insulator being adapted to receive seals to prevent ingress of drilling mud into said subassembly.

7. The electrical isolation connector of claim 1, wherein the exterior gap has a width ranging from about 4 cm to less than 50 cm.

8. The electrical isolation connector of claim 1, wherein the exterior gap has a width ranging from about 1 cm to less than 40 cm.

9. The electrical isolation connector of claim 1, wherein the exterior gap has a width ranging from about 2 cm to less than 30 cm.

10. The electrical isolation connector of claim 1, wherein the exterior gap has a width ranging from about 3 cm to less than 20 cm.

11. The electrical isolation connector of claim 1, wherein the exterior gap has a width ranging from about 5 cm to less than 10 cm.

* * * * *